United States Patent [19]

Lewyt

[11] Patent Number: 4,559,727

[45] Date of Patent: Dec. 24, 1985

[54] MARKETING DEVICE

[76] Inventor: Alexander Lewyt, 660 Madison Ave., New York, N.Y. 10021

[21] Appl. No.: 530,953

[22] Filed: Sep. 12, 1983

[51] Int. Cl.[4] ..... G09F 3/18

[52] U.S. Cl. ..... 40/10 R; 40/158 R; 40/159; 229/92.8; 283/56

[58] Field of Search ..... 40/159, 158, 10; 283/56; 229/92.8

[56] References Cited

U.S. PATENT DOCUMENTS

| | | | |
|---|---|---|---|
| 91,728 | 6/1869 | Eastman | 40/159 |
| 226,654 | 4/1880 | Eckman | 40/158 R |
| 522,484 | 7/1894 | Odgers | 40/159 |
| 2,948,977 | 8/1960 | Meissner | 40/158 R |

FOREIGN PATENT DOCUMENTS

| | | | |
|---|---|---|---|
| 307994 | 9/1955 | Switzerland | 40/158 R |

*Primary Examiner*—Gene Mancene
*Assistant Examiner*—Wenceslao J. Contreras
*Attorney, Agent, or Firm*—Kane, Dalsimer, Kane, Sullivan and Kurucz

[57] ABSTRACT

A mailable, promotional device is disclosed, usefully employed in promotional activities such as the assemblage of a mailing list. The device comprises, broadly, a wallet type of foldable display frame including tear off sheets for the inclusion of indicia to be returned to the promoter.

5 Claims, 4 Drawing Figures

MARKETING DEVICE

BACKGROUND OF THE INVENTION

Field of the Invention

The invention relates to marketing devices and more particularly relates to a mailable promotional device.

SUMMARY OF THE INVENTION

The invention comprises a mailable marketing device, which comprises;

a flat sheet of a flexible material having (A) a planar upper surface;

(B) a planar lower surface;

(C) a first edge;

(D) a second edge opposite the first edge;

(E) a third edge connecting the first edge to the second edge;

(F) a fourth edge opposite the third edge and connecting the first edge to the second edge at a point opposite the connection made by the third edge (E);

said first, second, third and fourth edges together forming the peripheral boundary of the sheet and joining the upper surface to the lower surface; said flat sheet also having (G) a first fold line bisecting the sheet into first and second half-sheets, said fold line extending from a point midway along the first edge to a point midway along the second edge;

(H) a second fold line bisecting the second half-sheet into first and second quarter-sheets, said second fold line extending from a point midway along the third edge to a point on the first fold line midway between the first and second edges;

(I) a slot in the sheet extending inwardly from the fourth edge to the first fold line along a straight line between the terminus of the second fold line on the first fold line and a point on the fourth edge midway between the first and second edges, said slot bisecting the first half-sheet into third and fourth quarter-sheets;

(J) an aperture through the third quarter-sheet providing open communication between the upper and the lower surfaces of the sheet, said aperture together with the boundary of the third quarter-sheet forming an outer peripheral zone of the third quarter-sheet;

(K) an adhesive composition positioned in the outer peripheral zone;

(L) a removable, flat bridge positioned across the aperture, attached to the inner peripheral zone along a frangible tear line, said bridge having upper and lower surfaces adapted to receive indicia; said sheet being folded along the first fold line so as to bring the upper surface of the first half-sheet adjacent to the upper surface of the second half-sheet, secured theretogether by the adhesive composition; the area between the peripheral zone and the adjacent second half-sheet being open space; said folded sheet being foldable along the second fold line.

The device of the invention is advantageous in that it may be inserted by machine into a mailing envelope. Mechanical envelope inserting machines are well known in the art.

DETAILED DESCRIPTION OF THE PREFERRED EMBODIMENTS OF THE INVENTION

The invention comprises a device which is usefully employed in marketing operations such as the solicitation of interest in particular commercial areas, the acquiring of promotional mailing lists and like marketing procedures.

The preferred mailable marketing device is described hereinafter in reference to the accompanying drawings of FIGS. 1–4, inclusive.

Figure 1:
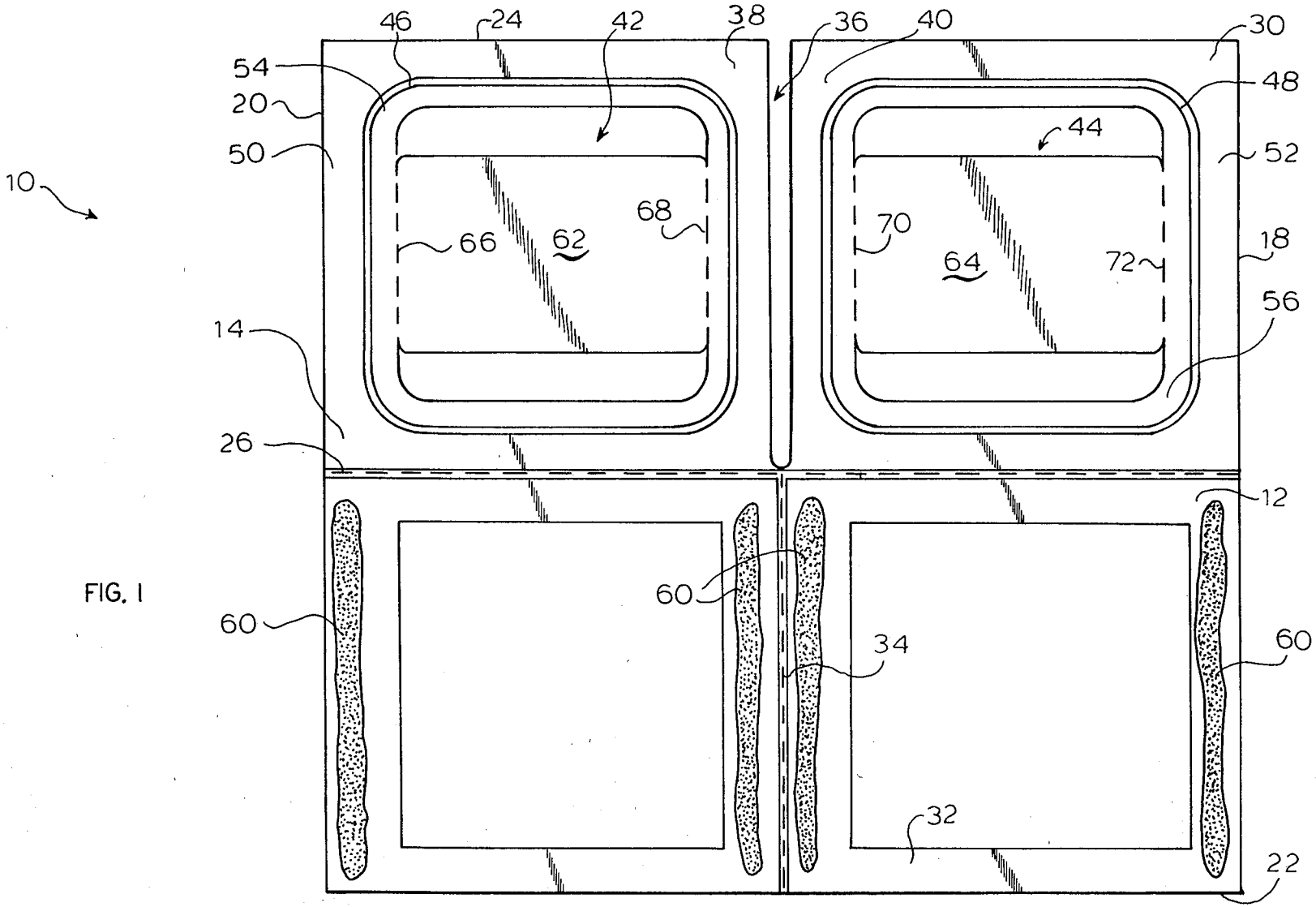
FIG. 1 is a top view of a blank from which a preferred embodiment marketing device may be assembled.

FIG. 1 is a top view of a preferred embodiment marketing device 10 of the invention which comprises a flat sheet 12 made up of a flexible material such as paper, synthetic polymeric resin films and the like. The sheet 12 has a planar upper surface 14 and a similar, planar lower surface 16 (not shown in FIG. 1). In addition, the sheet 12 has a first edge 18, a second edge 20 opposite the first edge, a third edge 22 connecting the first edge 18 to the second edge 20 and a fourth edge 24 opposite third edge 22 and connecting the first edge 18 to the second edge 20 at a point opposite the connection made by the third edge 22. The edges 18, 20, 22 and 24 together form a peripheral boundary of the sheet 12 and join the upper surface 14 to the lower surface 16. The flat sheet 12 has a first fold line 26 bisecting the sheet 12 into first and second half-sheets 30 and 32. The fold line 26 extends from a point midway along the first edge 18 to a point midway along the second edge 20. A second fold line 34 extends from a point midway along the third edge 22 to a point on the first fold line 26 midway between the first edge 18 and the second edge 20. A slot 36 in the sheet 12 extends inwardly from the fourth edge 24 to the first fold line 26 along a straight line between the terminus of the second fold line 34 on first fold line 26 and a point on the fourth edge 24 midway between the first and second edges 18, 20. Slot 36 bisects the first half-sheet 30 into third quarter-sheet 38 and fourth quarter-sheet 40. An aperture 42 through third quarter-sheet 38 provides open communication between the upper surface 14 and the lower surface 16 of sheet 12. A second aperture 44 is through the fourth quarter-sheet 40 to provide open communication between the upper surface 14 and lower surface 16 of sheet 12. Ridges 46 and 48 on the upper surface 14 of sheet 12 encircling the apertures 42 and 44, respectively, divide the periphery of the third and fourth quarter-sheets 38, 40, respectively, into outer peripheral zone 50 and outer peripheral zone 52, respectively, from inner peripheral zones 54 and 56. An adhesive composition 60 is positioned in the outer peripheral zone 50 or 52, respectively, after folding sheet 12 along fold line 26 as described hereinafter. A removable, flat bridge 62 partially closes aperture 42 while a similar bridge 64 partially closes the adjacent aperture 44. The bridges 62, 64 are removably attached to the respective inner peripheral zones 54, 56 along frangible tear lines 66, 68, 70 and 72. Thus, bridges 62 and 64 are removable by fracture of the respective tear lines. The bridges 62, 64 are made of the same material making up the sheet 12 but are adapted by composition or coating thereon to receive indicia such as will be described more fully hereinafter.

Figure 2:
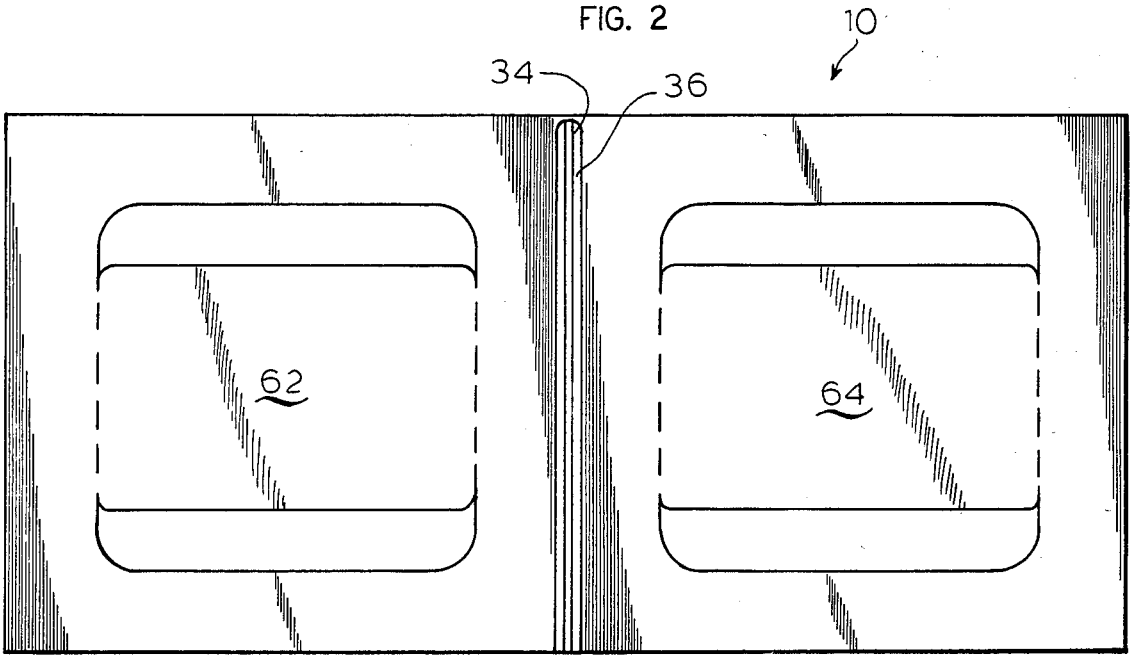
FIG. 2 is a side view of the embodiment blank shown in FIG. 1, after assembly.
Figure 3:
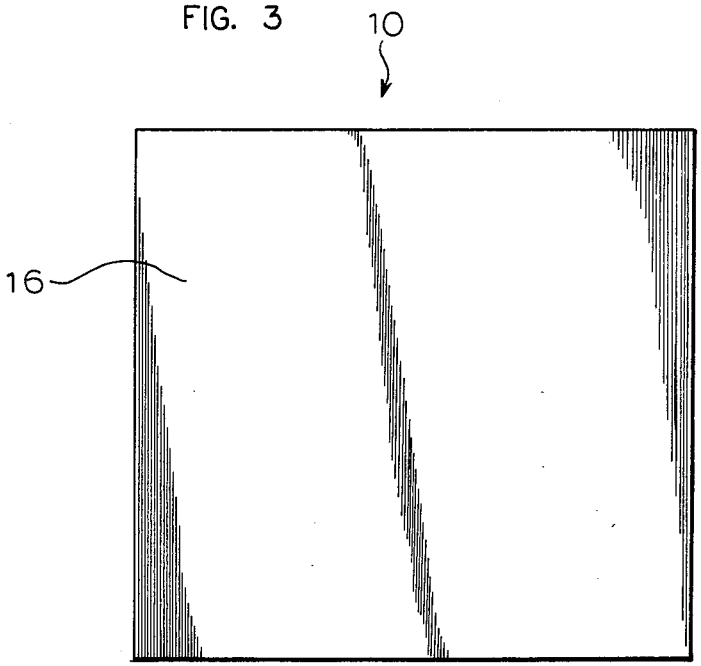
FIG. 3 is a top view of the embodiment shown in FIG. 2, after its closure.

Referring now to FIG. 2, one can see the embodiment device of FIG. 1 folded along fold line 26 so that upper surface 14 of half-sheet 30 is placed adjacent to the surface 14 of half-sheet 32. The composition 60 secures the half-sheets 30, 32 to each other in this position. The fold line 34 is visible through open slot 36. When the half-sheets 30, 32 are brought together as shown in FIG. 2, an open space exists in the area of the inner peripheral zones 54, 56 encircling the apertures 42, 44, respectively. This open space will receive the edges of a photograph or other promotional display inserted in the open apertures 42, 44. Insertion may be through the unsealed approximation of lower edge 22 with upper edge 24. Thus, the device 10 may function as a novel photo-frame. When folded closed along the fold line 36 as shown in FIG. 3, the wallet type of photoframe is closed. In FIG. 3, the reverse side of lower sheet surface 16 may be seen. FIG. 3 is a view of the device 10 as shown in FIG. 2 but folded closed along the fold line 36.

In use, any promotional message including photos, writing and like messages with visual impact may be inserted in the apertures 42, 44 and held in place for viewing when the device 10 is unfolded along fold line 36 so that the inner contents thereof may be viewed.

Figure 4:
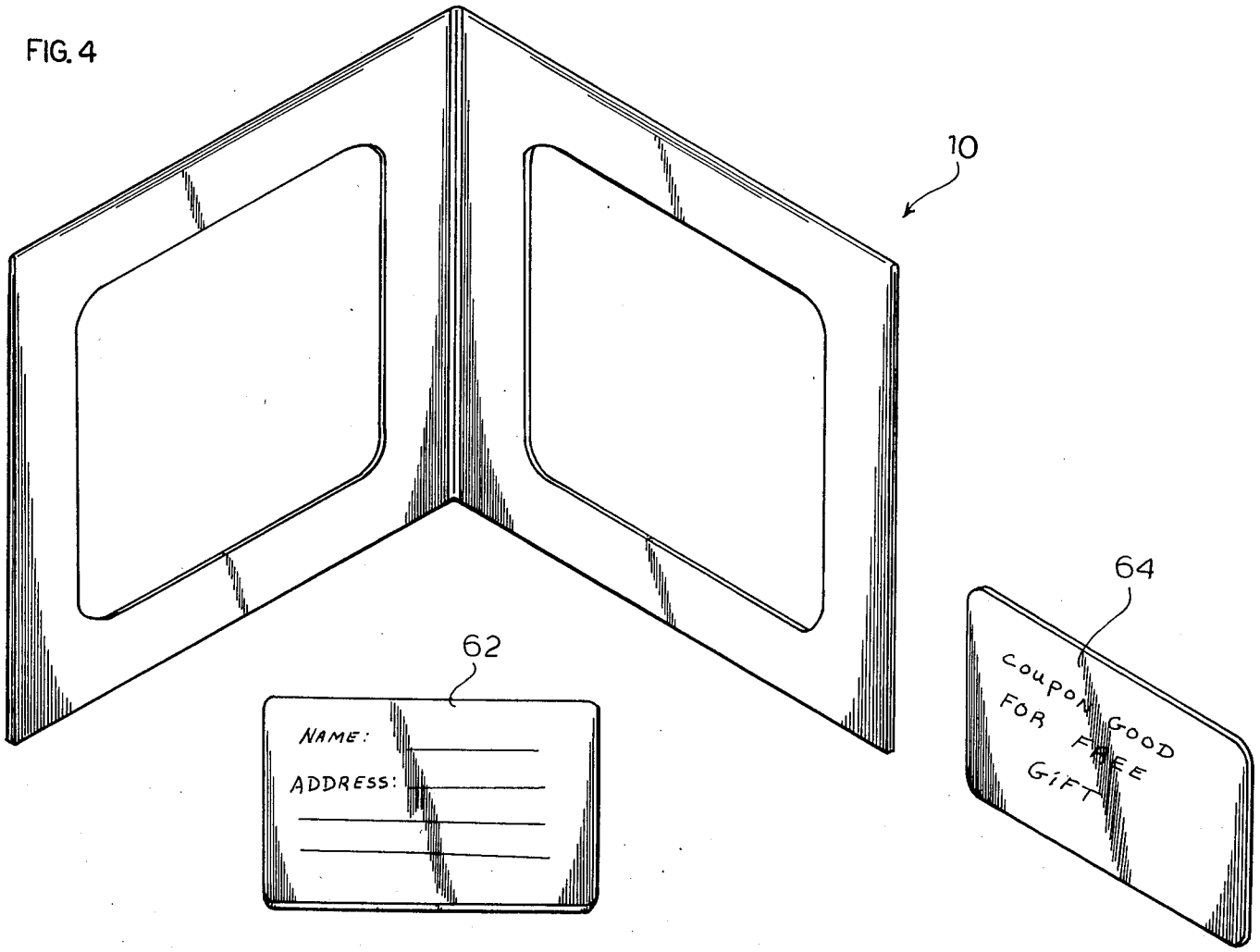
FIG. 4 is a view of the embodiment of FIG. 2, following partial disassembly of the promotional device.

FIG. 4 is a view of the embodiment device 10 as shown in FIG. 2, but with bridges 62 and 64 removed by tearing them out along the tear lines 66, 68, 70, 72. When torn out of the apertures 42, 44 the promotional material inserted in the apertures 42, 44 as described above, are fully visible to the holder. Advantageously, the bridges 62, 64 will bear on at least one surface indicia useful for the particular marketing promotion being undertaken. For example, one side of the bridge 62 may bear a format for one to write in their name and address and return it to the marketing promoter for the purpose of assembling a mailing list. The other side of the bridge 62, 64 may bear advertising material or, for example, indicate that upon mailing the removed bridge from the sheet 12, one may be entitled to receive a free gift, etc., i.e. a coupon offer, as shown in the FIG. 4.

Those skilled in the art will appreciate that the marketing device of the invention described above may be used in a wide variety of promotional activities and the nature of inserted advertising, etc., and the nature of the indicia placed upon the bridge components 62, 64, may be of great variety without departing from the spirit and the scope of the invention.

What is claimed:

1. A mailable marketing device, which comprises;

a flat sheet of a flexible material having (A) a planar upper surface;

(B) a planar lower surface;

(C) a first edge;

(D) a second edge opposite the first edge;

(E) a third edge connecting the first edge to the second edge;

(F) a fourth edge opposite the third edge and connecting the first edge to the second edge at a point opposite the connection made by the third edge (E); said first, second, third and fourth edges together forming the peripheral boundary of the sheet and joining the upper surface to the lower surface; said flat sheet also having (G) a first fold line bisecting the sheet into first and second half-sheets, said fold line extending from a point midway along the first edge to a point midway along the second edge;

(H) a second fold line bisecting the second half-sheet into first and second quarter-sheets, said second fold line extending from a point midway along the third edge to a point on the first fold line midway between the first and second edges;

(I) a slot in the sheet extending inwardly from the fourth edge to the first fold line along a straight line between the terminus of the second fold line on the first fold line and a point on the fourth edge midway between the first and second edges, said slot bisecting the first half-sheet into third and fourth quarter-sheets;

(J) an aperture through the third quarter-sheet providing open communication between the upper and the lower surfaces of the sheet, said aperture together with the boundary of the third quarter-sheet forming an outer peripheral zone of the third quarter-sheet;

(K) an adhesive composition positioned in the outer peripheral zone;

(L) a removable, flat bridge positioned across the aperture, attached to the inner peripheral zone along a frangible tear line, said bridge having upper and lower surfaces adapted to receive indicia; said sheet being folded along the first fold line so as to bring the slot over the second fold line and the upper surface of the first half-sheet adjacent to the upper surface of the second half-sheet, secured theretogether by the adhesive composition; said second fold being visible through the slot; the area between the peripheral zone and the adjacent second half-sheet being open space; said folded sheet being foldable along the second fold line so as to bring the lower surface of the third quarter-sheet adjacent to the lower surface of the fourth quarter-sheet, the third quarter-sheet being separate from the fourth-quarter sheet and unsecured theretogether so that a wallet-type of photoframe is openable and closeable along the second fold line for access and covering of the aperture and the removable flat bridge.

2. The device of claim 1 which further comprises;

(M) a ridge on the upper surface of the third quarter-sheet encircling the aperture at a point between the aperture and the boundary of the third quarter-sheet formed by the slot, the first fold line, the second edge and the fourth edge, said ridge together with the boundary of the third quarter-sheet forming the outer peripheral zone of the third quarter-sheet, said ridge together with the aperture defining an inner peripheral zone.

3. The device of claim 1 which further comprises;

(N) a second aperture through the fourth quarter-sheet providing open communication between the upper and the lower surfaces of the sheet.

4. The device of claim 3 which further comprises;

(O) a ridge on the upper surface of the fourth quarter-sheet, encircling the second aperture at a point between the second aperture and the boundary of the fourth quarter-sheet formed by the slot, the first fold line, the first edge and the fourth edge, said ridge together with the boundary of the fourth quarter-sheet forming a second outer peripheral zone of the fourth quarter-sheet, said ridge together with the second aperture defining a second inner peripheral zone;

(P) a second adhesive composition positioned in the second outer peripheral zone;

whereby when said sheet is folded along the first fold line, the upper surface of the first half-sheet is also secured to the upper surface of the second half-sheet by the second adhesive composition and there is open space in the area between the second inner peripheral zone and the adjacent second half-sheet.

5. The device of claim 4 wherein a second removable flat bridge positioned across the second aperture, attached to the second inner peripheral zone along a second frangible tear line, said second bridge having upper and lower surfaces adapted to receive indicia.

* * * * *